US009389049B2

(12) United States Patent
Hoetger

(10) Patent No.: US 9,389,049 B2
(45) Date of Patent: Jul. 12, 2016

(54) SHOOTING TARGET APPARATUS

(71) Applicant: Ralph Hoetger, Idyllwild, CA (US)

(72) Inventor: Ralph Hoetger, Idyllwild, CA (US)

( * ) Notice: Subject to any disclaimer, the term of this patent is extended or adjusted under 35 U.S.C. 154(b) by 0 days.

(21) Appl. No.: 14/533,447

(22) Filed: Nov. 5, 2014

(65) Prior Publication Data

US 2015/0145209 A1 May 28, 2015

Related U.S. Application Data

(60) Provisional application No. 61/963,084, filed on Nov. 22, 2013.

(51) Int. Cl.
*F41J 5/26* (2006.01)
*F41J 5/24* (2006.01)

(52) U.S. Cl.
CPC ..... *F41J 5/26* (2013.01); *F41J 5/24* (2013.01)

(58) Field of Classification Search
CPC ..... F41J 9/26; F41J 5/24; F41J 9/18; F16K 17/048
USPC ..... 273/348, 378, 380, 383, 393; 446/186–187, 220, 224
See application file for complete search history.

(56) References Cited

U.S. PATENT DOCUMENTS

| | | | | |
|---|---|---|---|---|
| 2,691,526 | A | 10/1954 | Wesley et al. | |
| 2,925,078 | A | 9/1958 | Ryan, Jr. | |
| 3,174,455 | A * | 3/1965 | Peterson | B64B 1/62 116/210 |
| 3,405,941 | A | 10/1968 | Martell et al. | |
| 3,411,778 | A | 11/1968 | Barry | |
| 3,595,436 | A | 7/1971 | Ohlund et al. | |
| 3,626,854 | A | 12/1971 | Brooks | |
| 3,831,315 | A * | 8/1974 | Gilbert | A63H 27/14 446/187 |
| 4,243,228 | A * | 1/1981 | Marcella | F41J 5/24 273/363 |
| 4,332,331 | A * | 6/1982 | Fawley | F17C 13/002 137/382 |
| 4,373,733 | A | 2/1983 | Smith, Jr. | |
| 5,222,740 | A | 6/1993 | Wu et al. | |
| 5,569,514 | A | 10/1996 | Ayres | |
| 5,588,896 | A * | 12/1996 | Goodman | A63H 27/10 124/57 |
| 5,690,338 | A * | 11/1997 | Cain | F41J 5/22 273/380 |
| 5,713,388 | A * | 2/1998 | Brewer | G01D 11/24 137/377 |
| 6,209,749 | B1 * | 4/2001 | Guess | F17C 13/084 137/377 |
| 8,556,269 | B2 | 10/2013 | Berger et al. | |
| 2004/0198150 | A1 * | 10/2004 | Nelson | A63H 27/10 446/224 |
| 2007/0135218 | A1 | 6/2007 | Wiliams et al. | |
| 2010/0276014 | A1 * | 11/2010 | Wilcox | F16K 11/165 137/511 |
| 2011/0049194 | A1 * | 3/2011 | Cannet | F17C 13/04 137/382 |
| 2011/0214759 | A1 * | 9/2011 | Grillmeier | B60K 15/03519 137/511 |
| 2013/0207347 | A1 | 8/2013 | Sovine | |

FOREIGN PATENT DOCUMENTS

| | | |
|---|---|---|
| CN | 2669128 | 1/2005 |
| DE | 2907329 | 3/1980 |

OTHER PUBLICATIONS

Daisy Manufacturing Co., http://www.target-factory.com/.
Rousseau, "Frangible Target With Hydraulic Warhead Simulator," Reg. No. H485 (Jul. 5, 1988).

* cited by examiner

*Primary Examiner* — Gene Kim
*Assistant Examiner* — Rayshun Peng
(74) *Attorney, Agent, or Firm* — Clement Cheng

(57) ABSTRACT

A shooting target apparatus which can be used for mounting air-pressurized containers as targets in shooting ranges. When the pressurized container is hit by a projectile, the sound of a small explosion provides an added excitement in the shooting experience. The container can also be partially filled with a fluid or granular material to create an added visual effect of an explosion.

9 Claims, 5 Drawing Sheets

SHOOTING TARGET APPARATUS

CROSS-REFERENCE TO RELATED APPLICATION

This Non-Provisional Patent Application claims priority to U.S. Provisional Application Ser. No. 61/963,084, filed on 22 Nov. 2013, incorporated herein by reference in its entirety.

FIELD OF THE APPARATUS

This apparatus relates generally to shooting target systems that provide an easy setup of targets for shooting practice using common containers, and more particularly to systems that provide a means of immediate feedback by visual, or auditory indications, or both.

BACKGROUND OF THE APPARATUS

There have been numerous targeting apparatuses invented for indicating accurate impact. Such targets are intended for use in testing ones skill in shooting some type of projectile. More particularly, devices are designed for use in target practice with a gun which fires bullets, an air gun which shoots pellets, or a bow which shoots arrows, all for the purpose of testing one's accuracy.

There are existing apparatuses intended for the above-mentioned general purposes. When a shooter is positioned at a substantial distance from conventional targets of the bull's eye type, or any other similar known target, it can be difficult to tell exactly whether or where one's bullet or arrow has hit the target.

One area of effort to overcome the above-mentioned problem has been the use of various optical devices, such as telescopes, binoculars, spotting scopes, or the like, so that one can view the target very carefully front the target shooting location for the purpose of attempting to determine precisely where the previously fired projectile has impacted the target. Under such field target shooting conditions, target shooters may set up cans or bottles rather than use conventional bull's eye-type paperboard or cardboard targets primarily because of the previous deficiency. Not immediately knowing the results of a shot is, of course, not true when one shoots at bottles, cans, or the like, where the impact of the fired projectile will be immediately perceptible to the shooter, either because the hit bottle shatters or the hit can is caused to fly from its previous at rest location, or it emits a loud sound when it is shot by a bullet. Either way, such a physical target in some way produces a visible indication to the shooter that the shot has hit the intended target, or, conversely, has missed it. That is the primary reason why such casual field target shooters frequently shoot at bottles, cans, electric power wire insulators, and other objects which will give of a visible indication when hit by a bullet.

SUMMARY OF EMBODIMENTS OF THE INVENTION

A purpose of the invention is to provide an inexpensive target apparatus which provides a user visual or audible, or both, indication when the target is hit.

An embodiment of the shooting target system includes setting up pressurized containers as targets in shooting ranges. When the pressurized container, such as a bottle, is hit by a pellet, bullet, or arrow, it is popped with a sound of a small explosion, providing an excitement in the shooting experience. The bottle may also be partially filled with water or a powder-like substance to create a visual effect of an explosion when the target is hit. The bottle is typically mounted onto a nipple or threaded receiver on the shooting target system. To pressurize the bottle, the bottle is mounted onto a nipple on the shooting target system. Then pressurized air is connected to a valve or an inlet opening in the target system. When the pressure in the bottle reaches a predetermined level, the target system with the bottle is set up as a target for shooting.

BRIEF DESCRIPTION OF THE DRAWINGS

Various objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION OF EMBODIMENTS OF THE INVENTION

Reference will now be made in detail to various exemplary embodiments of the invention. The following description is presented for the purpose of describing certain embodiments in detail. The apparatus is further illustrated in the accompanying drawing figures, attention being called to the fact, however, that the embodiments described and shown are illustrative only and are not intended to limit the scope of the concept. Changes may be made in the specific constructions disclosed herein that a person of ordinary skill in the art will recognize are within the scope and spirit of the described concept. Further, any features of any embodiment described herein are equally applicable to any other embodiment described herein or envisioned by one of ordinary skill in the art. The detailed description and figures provided herein should not be construed to exclude features otherwise described with respect to another embodiment.

Figure 1:
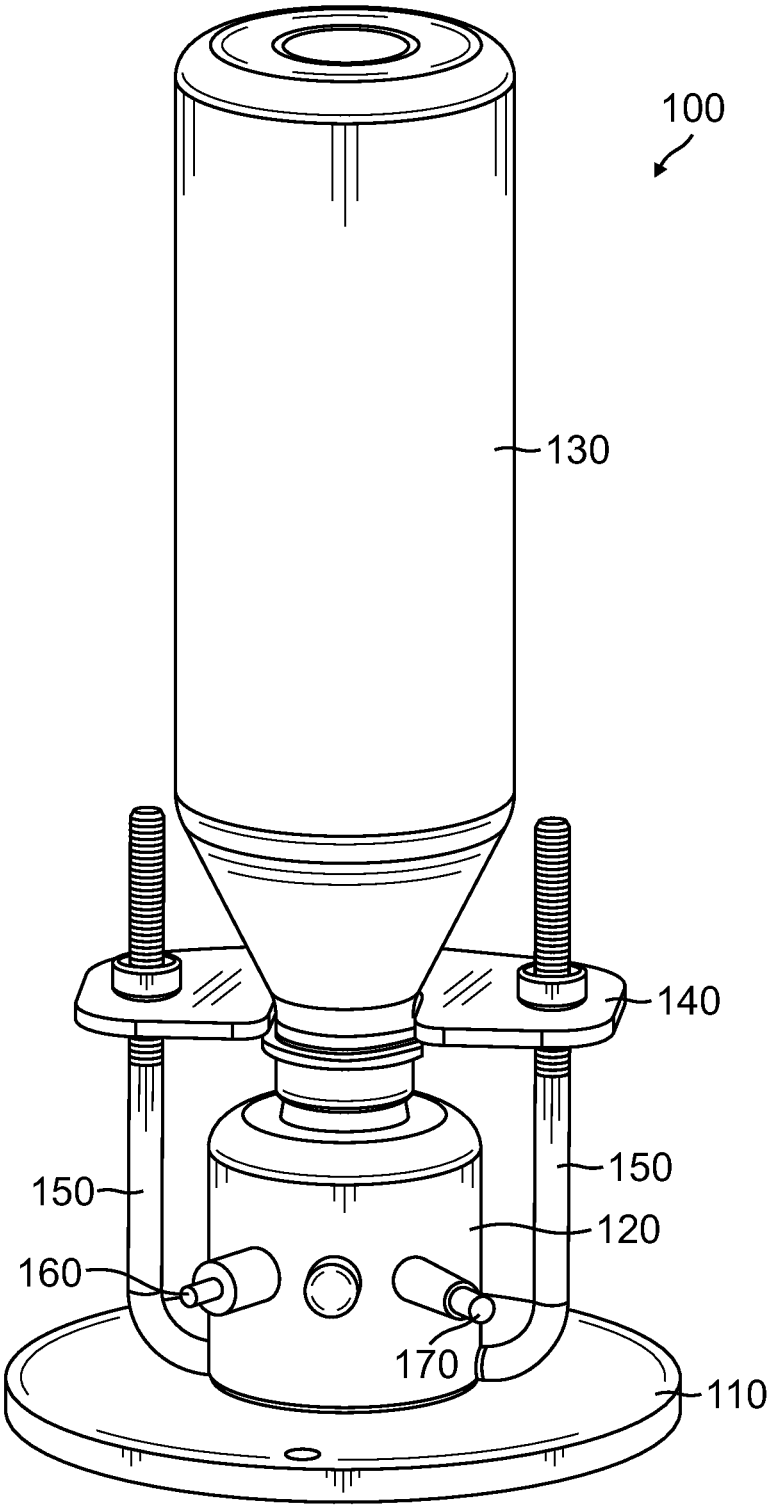
FIG. 1 is a front perspective view of a shooting target apparatus according to at least one aspect of the invention.
Figure 2:
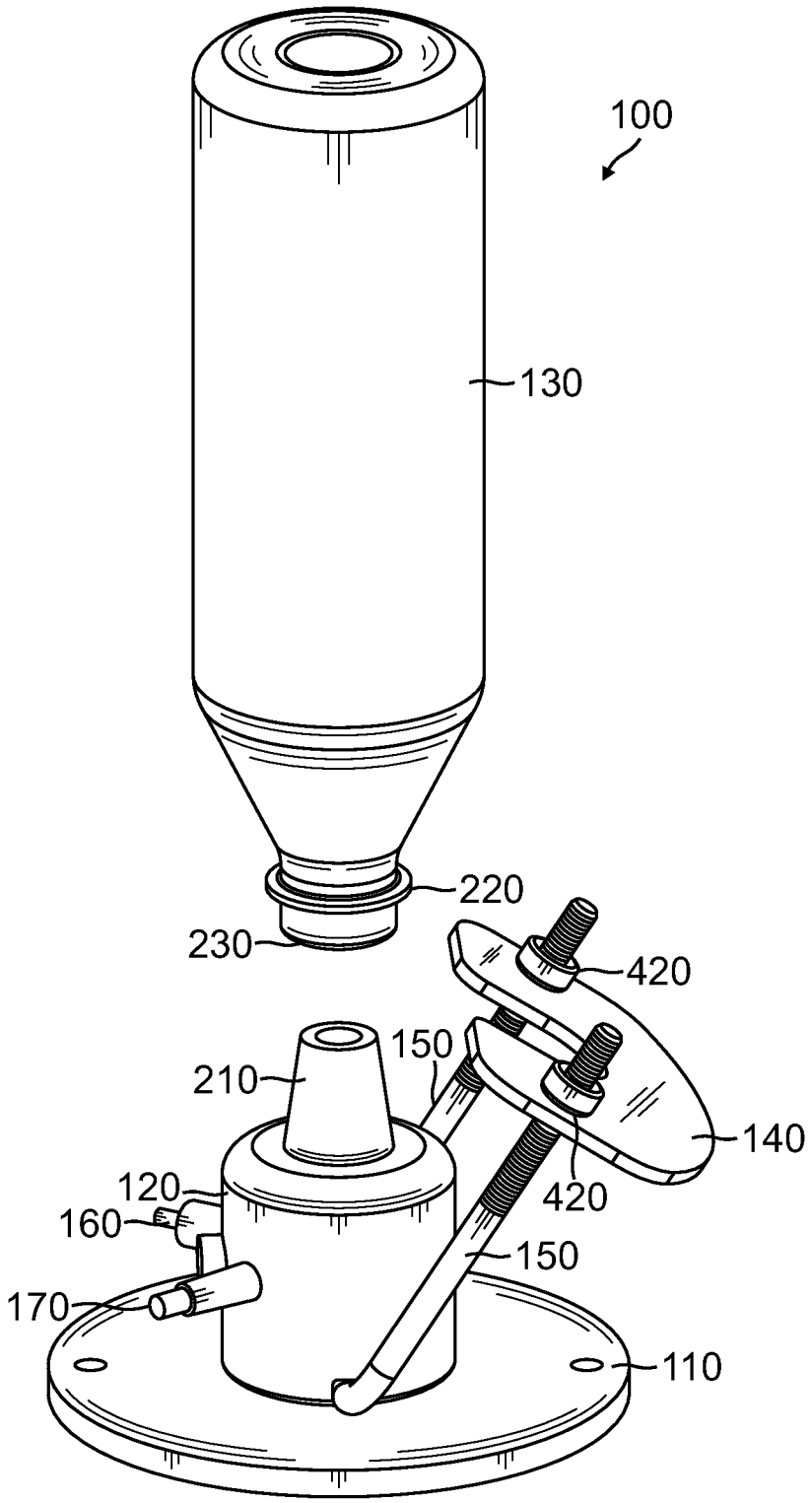
FIG. 2 is a side perspective view of the FIG. 1 apparatus with the target disengaged.
Figure 4:
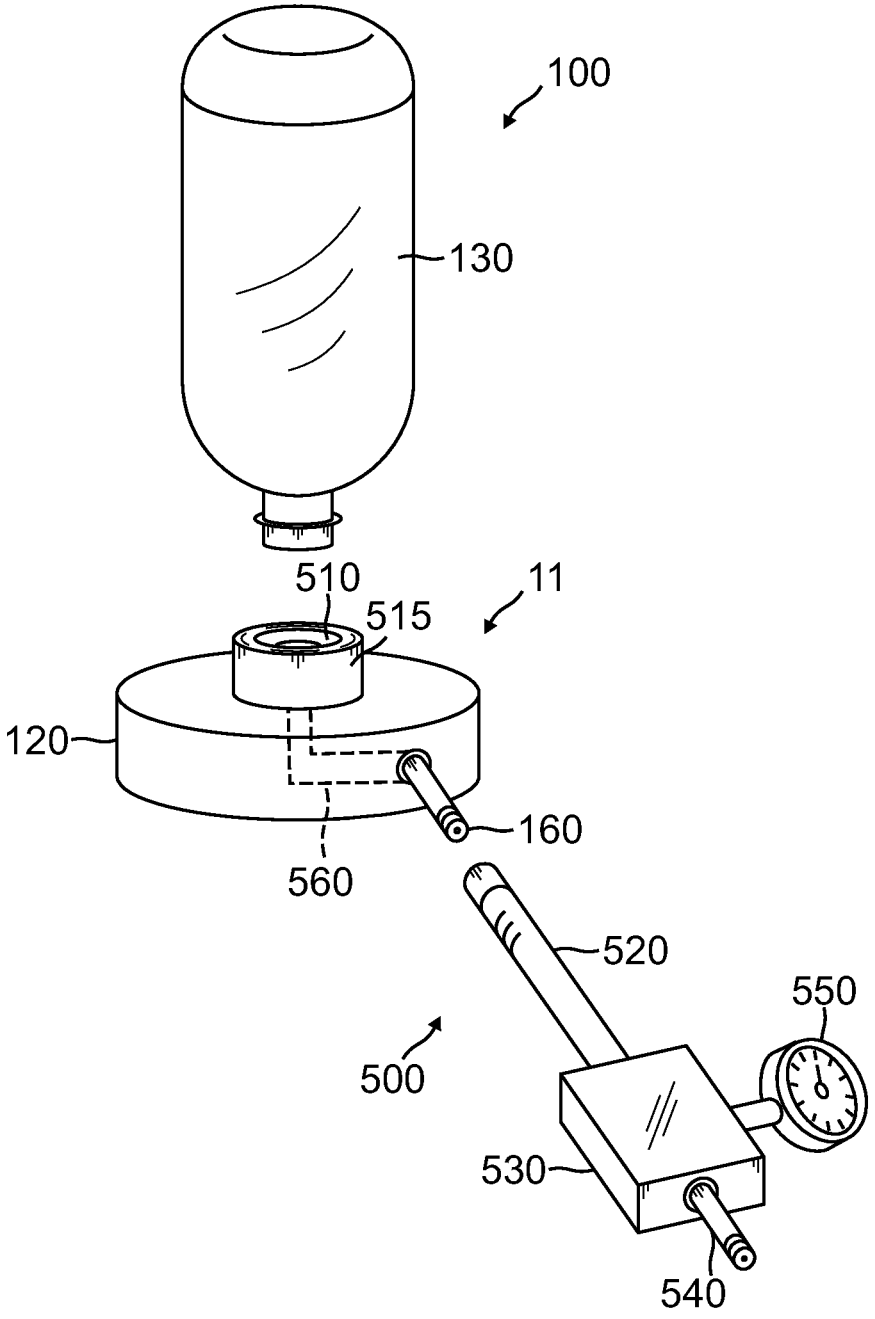
FIG. 4 is an exploded perspective view of alternative embodiment with an injector assembly.

Referring now to the drawing and more particularly to FIGS. 1 and 2, an embodiment of shooting target apparatus 100 is depicted. The apparatus includes base 110, body 120, nipple 210, and target holder 140. Target 130 is a replaceable container that is removably connected to the apparatus. The target may be threaded, clamped, or otherwise mounted onto the apparatus. Base 110 stabilizes the apparatus. It may be bolted to a substrate or may be heavy enough to support the apparatus on the ground or on a bale of hay, for example. The body, which includes the nipple, is attached to the base or it may be integrally formed with the base. The nipple and the base include an internal pathway 560, as shown in FIG. 4, to channel pressurized fluid, such as air. This is connected to first valve 160 which is adapted to be connected to a source of pressurized air. For the purposes of this description, the word "air" may be used interchangeably with any gas or liquid employed for added pressure purposes. After target 130 is securely mounted to nipple 210, pressurized air from a conventional source is connected to valve 160 to pressurize the target through the internal pathway. Target holder 140 is rotatably coupled to the body and provides a means for securing the target to the body.

Target 130 is a frangible container and is referred to herein as a bottle. The container may be plastic and provides visual impression upon being hit by a projectile of exploding when it is internally pressurized. The target could also be a bag, preferably having a defined volume. Such a bag would have an opening to receive pressurized air, in which the opening is adapted with a nipple or equivalent coupling on the body, with appropriate means to seal and hold the pressurized bag to the body. Such means could include a clamp, a band, or a string to tie the bag opening to the body. The body may alternatively include a check valve to prevent air backflow, although valve 160 can provide that function. There may be a second (relief) valve 170 which allows the release of air. When there are two valves, the first valve 160 allows for the intake of air whereas the second valve allows for the release of air. The first and second valves may be conventional bicycle or vehicle tire valves. Further, the first and second valves are typically one-way valves to allow for the passage of air and to prevent the backflow of the air.

Figure 3:
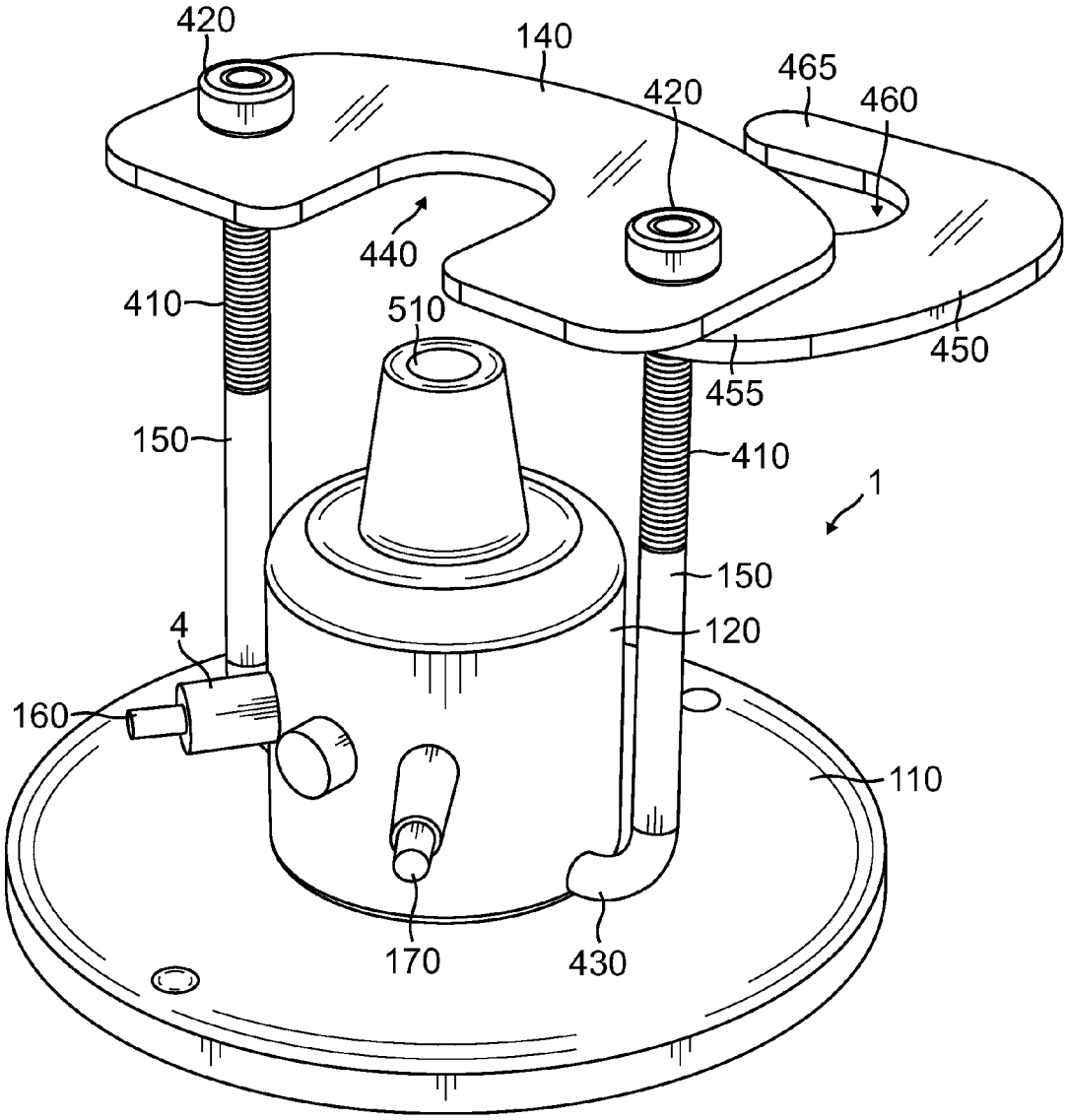
FIG. 3 is a perspective view of the apparatus of FIG. 1 without the target, and includes an alternative embodiment.

Body 120 may have a port 510 as shown in FIG. 3. The word "port" applies to the hole in nipple 210 for the purposes of this description. First, valve 160 receives air injected into the body and the air moves out to the port. The port receives the bottle while the bottle is pressurized and set up as a shooting target. As an alternative example, a check valve may be built into the body to prevent reverse airflow. This kind of valve is commonly used in bicycle tubes. Also, it can be a simple check valve allowing the airflow in one direction only. The body simply directs the airflow from the first valve to port 510 by means of a pathway, which may be pathway 560 in FIG. 3.

Referring to FIG. 2, target 130 is shown separated from nipple 210, and target holder 140 is disengaged. The nipple and the target holder hold the target while the target is pressurized and set as a target. The target holder has a slot 440, as shown in FIG. 3, which is configured to partially surround the neck area of the bottle. Bottles which are contemplated to be used as targets in this system are typically formed with a flange or annular bead 220 near the neck opening. The slot engages the neck part of the bottle just above (when the bottle is inverted) Range 220. The opening of the slot is smaller than the diameter of the flange so when the target holder is engaged with the bottle, the bottle is locked on the nipple. The nipple is preferably sloped or conical so that when the bottle is inserted on to it, the nipple acts as a plug, sealing the rim of bottle opening 230. The target holder is then screwed down with nuts 420 on the threaded portions 410 of arms 150, as shown in FIG. 3, to create and maintain an air tight seal with the bottle opening. The target holder is supported by arms 150 which can pivot about the body. FIG. 1 shows the bottle locked on the nipple with the target holder engaged on the neck part of the bottle. The length of the arms between target holder and pivot can be adjusted to fit any particular bottle.

As an alternative, a powder or fine granular material can be added within the target to enhance the visual evidence that the target has been struck by a projectile. The visual effect can be accentuated if the powder or granular material is colored.

Referring to FIG. 3, target holder 140 is in its upright, engaged position. The target holder arms pivot at elbows 430 on each side of body 120. When the arms pivot together to an upright position, the holder, which is located at the distal ends of arms 150, is in a position for slot 440 to slide onto the neck of the bottle, as shown in FIG. 1.

An alternative embodiment is also shown in FIG. 3, where small bottle adapter target holder 450 is optionally included with the FIGS. 1 and 2 embodiments. This is to enable the apparatus to accommodate bottles that have smaller necks than the bottle shown in FIGS. 1 and 2. Target holder 140 has slot 440 of what may be considered average size bottles. Target holder 450 has a narrower slot 460 to fit bottles having necks with a smaller diameter than the neck of target 130 shown in FIGS. 1 and 2.

Target holder 450 pivots laterally on one arm 150 on its proximal wing 455. Target holder 450 is smaller than is target holder 140 so that distal wing 465 does not engage with or encounter the opposite arm 150 when target holder 450 is pivoted into operative position to engage a bottle. Because target holder 450 is under target holder 140, threaded nuts 420 function to clamp a target bottle having a smaller-neck in place in the same manner as target holder 140 clamps a larger-neck bottle.

A simplified embodiment is shown in the exploded perspective view of FIG. 4. Injector assembly 500 attaches to first valve 160 to indicate the pressure in target 130 and to inform the operator in order to prevent premature explosion. An injector assembly includes manifold 530, inject tube 520, pressure gauge 550, and second valve 540. The manifold has air channels inside connecting parts as appropriate. The second valve is to receive airflow from a source of pressurized air. The second valve is also one-way to allow airflow into the manifold and to prevent airflow in the reverse direction. The air flows out from the manifold through the inject tube, which is attached to a second area of the manifold. The distal end of the inject tube has a fitting to engage first valve 160 to direct airflow from the manifold to the first valve. The pressure gauge measures and displays air pressure in the target. As shown, the threads at the opening of bottle 130 may be engaged with mating threads in port 510 of nipple 515 in this embodiment.

Figure 5:
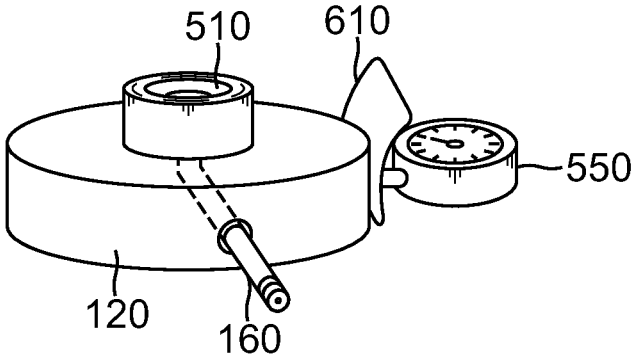
FIG. 5 is a perspective view of the base of FIG. 4 with a gauge and a gauge guard.

FIG. 5 depicts another alternative embodiment of the apparatus, similar to the FIG. 4 embodiment, including pressure gauge 550 which directly attaches to body 120 to measure and display the pressure inside the target bottle. A guard 610 is attached to the pressure gauge to protect the gauge from the projectiles fired by the user.

Figure 6:
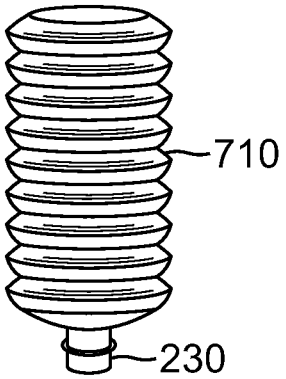
FIG. 6 is a perspective view of an alternative target.

FIG. 6 shows an alternative embodiment of a target bottle. In this example, bottle 710 has a bellows or accordion style configuration which can be compressed for handling and expands as it is pressurized. The bottle has opening 230 which is formed with internal or external threads that can be screwed onto the port, which would be formed with mating threads to receive the bottle. When the bottle is compressed, it will take the form of a circular puck-like object. When pressurized air is thread into the bottle, it will expand until it forms a full-sized bottle. The bottle retains the full-sized bottle shape while it is internally pressurized.

Figure 7:
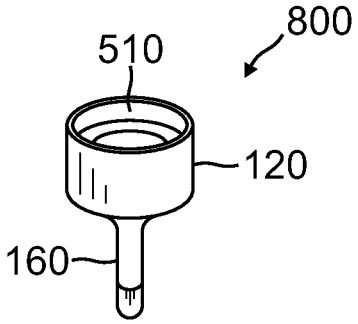
FIG. 7 is u perspective view of a simplified version of an alternative connector using a threaded can with an O-ring without the target.

Referring now to FIG. 7, a simplified embodiment or apparatus 800 is shown, including body 120, first valve 160, and port 510. As an example, the body is in a form of a threaded cap with an O-ring for a bottle with it port to receive the bottle. Within the cap are threads in this embodiment. Further, the mouth of the bottle would have mating threads. By having a male to female threaded interaction, the bottle is able to be screwed into the port. Once the bottle is screwed into the port, an air-tight seal is formed. The first valve is mounted to the body. This embodiment is similar to a portion of the embodiment described in FIG. 1 but, as shown here, the port does not have a base. Air can be injected from an injector assembly shown in FIG. 5 or directly from a pump into valve 160. The injector assembly may have a pressure gauge, as shown in FIGS. 4 and 5. Once the bottle is properly pressurized, air is prevented from escaping through a check valve system as previously described. Then the bottle can be attached to a separate base or target system to hold the bottle in place while it is pressurized until it is shot and popped. This embodiment includes the same features of the embodiments described previously.

Examples of suitable target containers are now discussed A typical thin-walled 500 ml plastic bottle is preferred for air gun target practice. Such bottles may have a bursting pressure of approximately 70 PSI and will generate an explosive decompression at a pressure above about 55 PSI when struck by a pellet or other projectile. In order to ensure that these bottles do not prematurely explode, a pressure relief valve, if employed, would be set at about 65 PSI.

It is preferred that the thicker-walled one and two-liter plastic bottle be employed as the targets for firearm and archery (including crossbow) practice. These bottles typically have a bursting pressure of about 140 PSI. The pressure relief valve for such bottles would likely be set at approximately 105 PSI. The pressure to obtain explosive decomposition for these thicker-walled bottles is about 95 PSI.

It should be understood that the above parameters are provided as examples only and could be varied by the user as desired.

As a further alternative, a pressure gauge can be employed directly with the FIGS. 1-3 embodiments, or it may be part of the compressed air supply apparatus.

Threads in target bottles can be engaged with mating threads on any mounting or nipple 210 in any of the described embodiments, and not just in the FIGS. 4, 6, and 7 embodiments.

While the present apparatus has been described in connection with what is considered a practical embodiment, it is to be understood that the apparatus is not to be limited to the disclosed arrangements, but is intended to cover various arrangements which are included within the spirit and scope of the appended claims so as to encompass all modifications and equivalent arrangements that are possible.

What is claimed is:

1. A shooting target apparatus comprising:

a base;

a body on said base;

a first valve on said body adapted to be connected to a source of pressurized fluid;

a nipple projecting from said body, wherein said body and said nipple include a pathway therein formed to channel fluid between said first valve and said nipple, said nipple being shaped and configured to removably receive a target; and a first target holder coupled to said body, said first target holder being configured to selectively engage a target, wherein said first target holder is configured to removably secure a target to said nipple; wherein said target holder comprises alternative means to engage targets of different sizes, wherein said alternative means comprises a second target holder coupled to said first target holder, said second target holder being configured to selectively engage a target of a size that differs from the target for which said first target holder is configured, wherein said second target holder is configured to removably secure a target to said nipple.

2. The shooting target apparatus of claim 1, wherein the nipple is sloped to act as a plug; and a first target holder coupled to said body, said first target holder being configured to selectively engage a target, wherein said first target holder is configured to removably secure a target to said nipple and further comprising a second valve which selectively allows the release of pressure, wherein said first valve provides for the intake of fluid.

3. The shooting target apparatus of claim 1, wherein an injector assembly having a pressure gauge is attached to said first valve to indicate the pressure in a target when the target is mounted to said nipple.

4. The shooting target apparatus of claim 1, wherein said first valve and a second valve are one-way valves to allow for the passage of fluid in one direction and to prevent the backflow of fluid.

5. The shooting target apparatus of claim 1, wherein the target has a powder or granular material therein.

6. The shooting target apparatus of claim 1, wherein said first target holder is pivotable on said body to selectively engage a target and lock it in place.

7. The shooting target apparatus of claim 1, wherein said target holder comprises alternative means to engage targets of different sizes.

8. The shooting target apparatus of claim 1, wherein said first target holder is a threaded structure configured to secure the target by a screwing motion.

9. The shooting target apparatus of claim 1, wherein an injector assembly is attached to said first valve to check the pressure in the target to prevent premature explosion.

* * * * *